United States Patent [19]

Rippere

[11] 3,994,785

[45] Nov. 30, 1976

[54] ELECTROLYTIC METHODS FOR PRODUCTION OF HIGH DENSITY COPPER POWDER

[76] Inventor: Ralph E. Rippere, 4145 W. Banff Lane, Phoenix, Ariz. 85023

[22] Filed: Jan. 9, 1975

[21] Appl. No.: 539,771

[52] U.S. Cl. ..... 204/10; 204/23; 204/223; 204/228; 204/DIG. 9

[51] Int. Cl.[2] ..... C25D 3/38; C25D 5/18; C25D 7/00

[58] Field of Search ..... 204/10, 223, 222, 228, 204/DIG. 9, DIG. 8, 23

[56] References Cited

UNITED STATES PATENTS

| | | | |
|---|---|---|---|
| 521,991 | 6/1894 | Sachs et al. | 204/10 |
| 1,440,502 | 1/1923 | Slepian | 204/10 |
| 1,777,371 | 10/1930 | Koehler | 204/10 |
| 1,986,197 | 1/1935 | Harshaw | 204/23 |
| 2,216,167 | 10/1940 | Fisher | 204/10 |
| 2,524,912 | 10/1950 | Jernstedt | 204/DIG. 9 |
| 2,651,609 | 9/1953 | Chester | 204/DIG. 9 |
| 2,678,909 | 5/1954 | Jernstedt et al. | 204/DIG. 9 |
| 3,535,218 | 10/1970 | Brown et al. | 204/10 |
| 3,577,324 | 5/1971 | Patterson | 204/23 |
| 3,654,098 | 4/1972 | Backhurst et al. | 204/222 |
| 3,703,446 | 11/1972 | Haycock et al. | 204/222 |
| 3,779,873 | 12/1973 | Dewar | 204/222 |

*Primary Examiner*—T. M. Tufariello
*Attorney, Agent, or Firm*—Finnegan, Henderson, Farabow & Garrett

[57] ABSTRACT

Electrolytic methods for making high density copper powder starting with copper powder of lower apparent density are disclosed. Copper powder of lower apparent density is used as a cathode for the formation of copper powder having a desired relatively high apparent density. According to one embodiment, an integral two-phase process is provided in which copper powder of relatively lower apparent density is formed by electrodeposition, and the powder so-formed is then used in a second phase electrodeposition process as a cathode on which copper powder of the desired relatively high apparent density is formed.

17 Claims, 2 Drawing Figures

ELECTROLYTIC METHODS FOR PRODUCTION OF HIGH DENSITY COPPER POWDER

BACKGROUND OF THE INVENTION

An expanding area of technological innovation of diverse application is that of power metallurgy. Metal compositions and forms can be obtained by pressure molding fine metal powders or mixtures of powders into a desired shape. The pressed object may then be heated, in an atmosphere which protects the metal against oxidation, at a temperature at which the crystals of the metal powder grains grow and regrow into each other across the powder grain boundaries without melting. In this fashion, the metallic crystalline equivalent of conventional production by casting and machining is produced. Powder metallurgy methods are especially favorable and desirable where one is concerned with conserving energy and materials as well as avoiding the waste and losses which attend the usual conventional melting, casting, rolling, and machining used to produce metal machinery components.

Requisite to utilization of powder metallurgy is the availability of metal in a suitable degree of fineness, density, and chemical condition. To provide the needs, a wide variety of methods including grinding, atomizing, chemical conversion, and electrodeposition are used.

Electrodeposition is a general method which has the advantage of a wide range of controlling parameters capable of being set at predetermined levels, operable over useful periods with stability and reasonable plant construction costs.

Electrodeposition has been used in the specific context of copper powder production. Commercially available copper powders produced by electrodeposition from water solutions are typically of two general types or classes. One class comprises fine powders of −325 mesh and apparent densities below 1 g/cc. These powders exhibit a fine branched crystal structure suggesting a fern frond and are called dendritic. The other class includes +325 to −100 mesh fine powders with apparent densities usually in a range of 2.5 to 2.7 g/cc. These powders are more compact than the dendritic and are called nodular.

Copper in the usual solid form has a density of 8.9 g/cc, i.e., 1 cubic centimeter of copper in such form weighs 8.9 g. A powder of apparent density of 2.9 requires over 3 cubic centimeters to form 1 cubic centimeter of copper after compression and sintering. Therefore, the greater the apparent density of the starting powder, the smaller the volume that will be required to form the same final product. The powder of highest apparent density obtainable will be most efficient in production of, for example, an extruded heat exchange tube as well as other articles. For a fixed length of extrusion cylinder and expressing ram, in the case of, for example, an extruded heat exchange tube, the longest length will be obtained from the powder of highest apparent density.

In an article entitled "Production of Electrolytic Copper Powder" by F. Wills and E. J. Clugston, Journal of the Electrochemical Society, Vol. 106, pages 362–366 (April, 1959), four general stages of processing were reported during which the properties of the powder, particularly apparent density, could be changed — (1) electrodeposition; (2) furnacing; (3) grinding and screening; and (4) blending of powders.

Most of the grades of powder produced had an apparent density of about 2.7 g/cc or less (Table IV, Page 365). The highest density powder had an apparent density of 3.5–4.0 g/cc. This was powder which had been worked extensively during the first three stages and was reported to have application in specialized usage.

Formation of copper powder by electrodeposition has been examined on a laboratory scale. D. W. Drumiler, R. W. Moulton, and G. L. Putnam, in an article entitled "Electrodeposition of Copper Powder from Acid Sulphate Baths", Industrial & Engineering Chemistry, Vol. 42, pages 2009–2102 (October, 1950), reported experimental results. In some cases, relatively high apparent density in g/ml. were obtained, and the researchers attempted to empirically correlate a number of variables including apparent density. However, the experimental conditions yielded poor efficiency, and the report fails to provide a practical method adaptable to commercial conditions for predictably producing copper powder of high apparent density.

There has been a need in the art for methods of the production of high apparent density copper powder with simplicity and control. The present invention addresses this need and provides for the manufacture of copper powder of high apparent density by electrolytic techniques. Through use of the present invention, high apparent density copper powder can be made with high efficiency, simplicity of operation, and reproduceable control. In addition, the present invention is capable of producing intermediate apparent densities with control and high efficiency in use of material, power and equipment thereby allowing the manufacture of powder having preselected apparent density.

It is therefore a primary object of the present invention to provide a new and improved method of manufacturing high apparent density copper powder.

It is a further object of this invention to provide an electrodeposition method of producing high apparent density copper powder that is relatively simple, reproduceable, and efficient.

Another object of this invention is to provide an electrodeposition method making high apparent density copper powder in which the apparent density of the final product can be readily and predictably controlled.

Yet another object of this invention is to provide a new and improved method of making a high apparent density copper powder starting with a copper powder of relatively low apparent density.

An additional object of this invention is to provide a method of making high apparent density copper powder by an electrodeposition process using low apparent density copper power as a cathode.

Another object of this invention is to provide a new and improved integral process in which a low apparent density copper powder is first produced by an electrodeposition process and then used as a cathode for the production of high apparent density copper powder in a second electrodeposition process.

A further object of this invention is to provide a method of producing high apparent density copper powder from an electrolytic composition by an electrodeposition method without changing the composition of the electrolytic solution during the process.

Additonal objects and advantages of this invention will be set forth in part in the description which follows and in part will be obvious from the description or may be learned by practice of the invention. The objects and advantages of the invention may be realized and attained by means of the method, compositions, combinations and instrumentalities particularly pointed out in the appended claims.

SUMMARY OF THE INVENTION

To achieve the foregoing objects and in accordance with the purpose of the invention as embodied and broadly described herein, there is provided a method of producing copper powder having a desired relatively high apparent density comprising electrodepositing copper powder from an electrolytic composition having copper ions onto a cathode comprising copper powder having a lower apparent density, and continuing the electrodeposition until copper powder having the desired higher apparent density is formed. The electrodeposition is effected by imposing a low current of such magnitude that no hydrogen gas is evolved.

In a preferred embodiment of the invention, a two-phase process for producing copper powder of a desired relatively high apparent density is provided wherein copper powder having a lower apparent density is formed in the first phase by electrodepositing copper powder from an electrolytic solution onto a cathode, and, in the second phase, electrodepositing copper powder from an electrolytic solution onto the copper powder formed in the first phase by imposing a low current of such magnitude that no hydrogen gas is evolved, and continuing the second-phase electrodeposition until copper powder having a desired higher apparent density is formed.

The present invention as broadly described herein provides a method of producing a copper powder having a desired relatively high apparent density starting with copper powder of a lower apparent density. In general, the starting copper powder can have an apparent density falling in the range of from about 0.5 to about 4.0 g/cc, and by employing the electrodeposition process of this invention, the apparent density can be increased to from about 2.5 to about 5.0 g/cc. Preferably, the starting lower apparent density copper powder has an apparent density less than about 3.0 g/cc, and the electrodeposition process of this invention produces relatively high apparent density copper powder having an apparent density of at least about 3.0 g/cc. The process of this invention is therefore preferably continued until there is formed copper powder having a desired apparent density of 3.0 g/cc or greater, the process being capable of control to produce copper powder having a generally preselected relatively high apparent density.

The electrolytic composition used in the electrodeposition process of this invention is one which has copper ions and hydrogen ions in an electrolyte. Preferably, the electrolytic composition is an aqueous solution containing copper sulfate and sulfuric acid. Other suitable compositions include aqueous solutions of copper chloride and hydrochloric acid; and copper chloride, sulfuric acid and sodium chloride, etc.

In the two-phase embodiment of the process of this invention, the electrolytic composition used in the two phases may be the same or different. Preferably, the same composition is used in the first and second electrodeposition phases.

The electrodeposition may be accomplished in any suitable electrolytic chamber means. The electrolytic chamber means is provided with electrodes and a source of electrical current in communication therewith.

In accordance with the invention, and as broadly embodied herein, the current density during electrodeposition of copper onto copper powder of lower apparent density to produce copper powder having a higher apparent density is such that no hydrogen gas is evolved during electrodeposition. Preferably, direct current is used. During electrodeposition, current flow is interrupted, preferably periodically. It is preferred that direct current be used to effect electrodeposition, in which case the interruption is by periods of reversed direct current or interposed alternating current.

Where a two-phase integral process is used, as embodied herein, direct current is preferably used to effect electrodeposition of lower apparent density copper powder in the first phase from the electrolytic composition onto a cathode. Preferably, the forward direct current effecting electrodeposition is interrupted with periods of cessation of current, reversed direct current, or interposed alternating current. The so-formed powder is released from the cathode and is then used as an electrode for the second phase electrodeposition process to produce copper powder of higher apparent density. In this two-phase integral process, hydrogen gas evolution is obtained to facilitate the ready removal of the first phase deposit from the cathode.

BRIEF DESCRIPTION OF THE DRAWINGS

The invention consists in the novel processes, steps, combinations, arrangements, constructions, and improvements shown and described. The accompanying drawings, which are incorporated in and constitute a part of this specification illustrate preferred embodiments of the invention, and together with the general description of the invention above and detailed description of preferred embodiments given below, serve to explain the principles of the invention.

The above general description and the following detailed description are merely illustrative of the invention, and additional modes, advantages, and particulars of this invention will be readily suggested to those skilled in the art without departing from the scope or spirit of the invention.

DETAILED DESCRIPTION OF THE INVENTION

Figure 1:
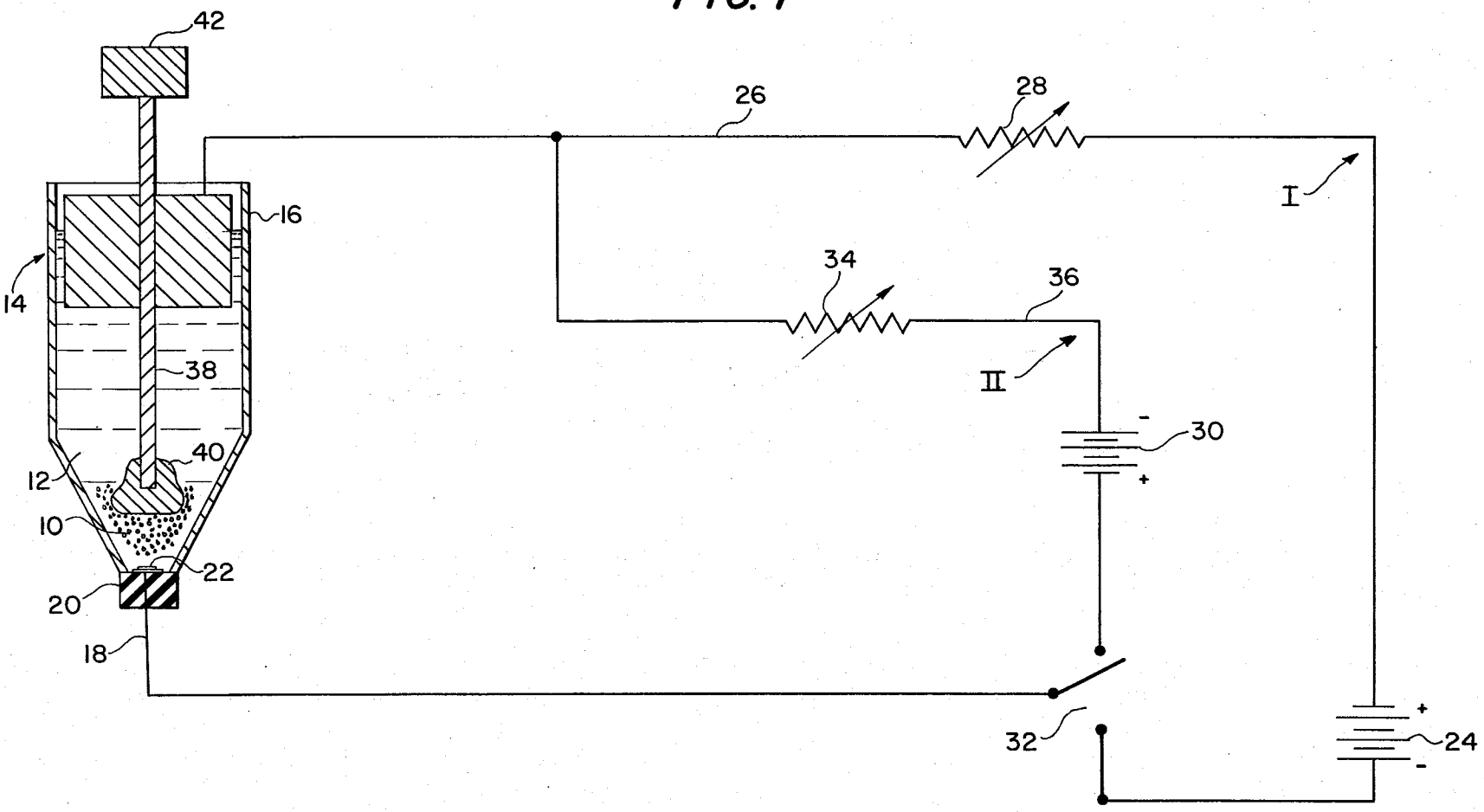
FIG. 1 shows schematically, and in partial cross-section, a view of an assembly by which electrodeposition of copper onto low apparent density copper powder to produce higher apparent density copper powder may be carried out according to the invention.

In accordance with the invention and as embodied in FIG. 1, there is provided copper powder 10 of relatively low apparent density, preferably less than about 3.0 g/cc. The powder 10 is dispersed in an electrolytic composition 12 which is maintained in electrolytic chamber means, shown in FIG. 1 as electrolytic cell 14. Powder 10 functions as an electrode, primarily a cathode, in the practice of this invention as further described below. The copper powder 10 may be produced in a variety of ways such as are known in the art.

It is particularly advantageous to produce copper powder 10 as described below in connection with FIG. 2.

Any composition containing copper ions and hydrogen ions capable of electrodepositing copper on a cathode when electric current is imposed may be used as the electrolytic composition 12 according to the present invention. An aqueous solution of copper sulfate and sulfuric acid has been found to give excellent results and is presently preferred. The copper sulfate preferably comprises from about 125 g/l to about 250 g/l and especially about 210 g/l. The sulfuric acid preferably comprises from about 75 g/l to about 90 g/l, and especially about 80 g/l. Copper chloride is another example of a useful source of copper ions. In addition, acids other than sulfuric acid may be used. In general, such acids are inorganic acids, which are relatively strong. Hydrochloric acid is a suitable acid. Preferably, the acid has the same anion as the copper compound.

As is known in the art, there are many additives which can be used in electroplating solutions, the additives having deposit modification effects at low concentrations. Such additives include brighteners, leveling agents, stress relievers, grain refiners, additioners, and the like. Their specific contributions to the final product can be demonstrated and controlled by a variety of means and measurements, as is known in the art. It is within the concept of the present invention to use in the electrolytic composition any additive useful in producing beneficial effects in the electroplating solutions.

The additives known in the art are primarily organic in nature and are frequently complex mixtures. The solutions must be periodically purged of the breakdown products of these additives. This purging can be accomplished by further oxidation using hydrogen peroxide followed by dosing with activated carbon and subsequent filtration to remove the absorption agent. While, as noted above, such additives may be beneficially used in connection with the present invention to obtain effects as are taught in the art, the monitoring and purging of electrolytic compositions containing such additives is frequently time consuming and costly.

While electroplating problems have often been sought to be solved by the discovery and use of a specific additive, the present invention does not require such additives and has been demonstrated to be successful without them. The use of a three component system consisting of water, copper sulfate, for example, and sulfuric acid, for example, is preferred in that it has the advantage of leading to high apparent density copper powder without the need for further additives which contributes to the cost of the operation.

The chamber means in which electrodeposition is effected may be any suitable electrolytic cell. As shown and embodied in FIG. 1, the electrolytic cell 14 comprises a glass container having a sloped bottom. An exemplary laboratory scale plating cell actually used had a height of 10 inches, with the conical bottom portion comprising 4 inches in height, and having a slope at an angle of about 82° from the horizontal. The diameter of the cell along the cylindrical upper portion was 2⅞ inches.

In addition to glass plating cells, plastisol-lined steel, fiberglass epoxy, and fiberglass polyester cells are illustrative of plating cells which may be used. A non-metallic interior is preferred so as to avoid interference by the cell with the electrodeposition process and to prevent corrosion problems.

In accordance with the invention, the electrolytic cell 14 is provided with an electrode in addition to copper powder 10. As embodied and shown in FIG. 1, the electrode comprises conductor 16. In the embodiment illustrated in FIG. 1, conductor 16 comprises a metal cylinder suspended by means (not shown) in the electrolytic solution 12.

The metal cylinder 16 is preferably of copper, although it is within this invention to use other means. A copper cylinder used in conjunction with the aforementioned laboratory scale cell was formed from a 6 inch by 4 inch rectangular slab of copper, ⅛ inch thick. The slab was bent into a split cylinder 2½ inches in diameter.

The conductor 16 functions primarily as the anode. However, it may function as a cathode by reversal of current flow.

In keeping with the concept of the invention, there is provided electrical contact to the copper powder 10. As embodied and shown in FIG. 1, conductor 18 provides such electrical contact, and it comprises a thin metal wire, preferably of copper and suitably protected by an insulating sheath, i.e., ordinary copper electrical wire. Conductor 18 extends through insulating plug 20 and culminates in contact point 22 at the bottom of the cell 14 in the solution 12. Contact 22 may be, for example, a flat spiral of number 16 gauge copper wire, and the insulated plug 20 may be an ordinary rubber stopper.

The conductors 16 and 18 are in communication with a source of electric current. In the embodiment illustrated in FIG. 1, the primary source of current for electrodeposition is shown schematically as direct current battery 24, which comprises the source of power for Circuit I. A lead acid storage battery, nominal 2 volts/cell, was used in laboratory scale equipment. Circuit I, when in operation, effects electrodeposition of copper from solution 12 with cylinder 16 functioning as the anode and copper powder 10 functioning as the cathode.

As embodied in FIG. 1, the copper cylinder 16 communicates with battery 24 through electrical conductor 26, which is preferably ordinary electrical copper wire protected by an insulating sheath. Although not essential to the electrodeposition process, it is preferred to employ a current regulating means, shown and embodied in FIG. 1 as variable resistor 28, which permits variation and control of the current introduced into the electrolytic cell 14.

Any conventional variable resistance mechanism may be used in the practice of the invention. A variable resistor actually used on a laboratory scale consisted of four to eight strands of 1/16th inch wide nichrome resistance ribbon stretched in parallel and clamped by machine screws and washers to ⅛th inch thick square copper channels. The length was 24 inches. An adjustable length contact to all ribbons was constructed in the same manner and joined to one end by a heavy conductor.

In accordance with the invention, there is provided means for interrupting the electrodeposition process. As shown and embodied in FIG. 1, interruption is facilitated by employing a source of direct current having a direction of flow reverse to that created by battery 24, said source shown as battery 30, and comprising the source of power for Circuit II. Circuits I and II are alternative in that in practice, for a period of time, Circuit I is in operation causing plating or deposition, while for a different period of time, interruption Circuit II is in operation causing some deplating as further explained below.

Means for selecting the desired circuit is provided, and as shown and embodied in FIG. 1, such means comprises switch mechanism 32. Preferably, a variable resistance means shown in FIG. 1 as variable resistor 34, is used in conjunction with battery 30, connected thereto by conductor 36, which may be ordinary electrical wire.

Battery 30 and variable resistor 34 may be the same as battery 24 and variable resistor 28, or may be different. Instead of a source of reverse direct current, such as battery 30, a source of alternating current, such as a 60 cycle, 115 volt A.C. generator, may be used to effect interruption of the electrodeposition process. Preferably, means are provided to vary the A.C. output, such as by providing an autotransformer, e.g., as marketed under the name "Variac".

Any suitable switch mechanism 32 may be used as means for electrically connecting electrodes 16 and 10 with either Circuit I or Circuit II. It is preferred to provide means for timed switching from one circuit to the other. Thus, it is preferred to utilize a switch mechanism which can be set to periodically switch over from the primary Circuit I to interrupting Circuit II according to a predetermined schedule, and which preferably permits modification of the schedule as desired.

Illustrative of suitable switch mechanisms which may be used in the practice of this invention is a microswitch in communication with a cam device. By use of appropriate cams, different cycles of switching from Circuit I to Circuit II and back to Circuit I can be employed.

In accordance with the invention, there is preferably provided means for agitating the copper powder 10 and electrolytic solution 12. As embodied and shown in FIG. 1, agitating means comprises a stirring device 38 having a blade 40 immersed in both the electrolytic solution 12 and the copper powder 10. The stirring device is driven by a motor shown generally at 42.

Certain modifications of the system shown in FIG. 1 will be apparent to those skilled in the art. For example, ammeters are preferably placed in Circuits I and II to measure current, and a voltmeter is likewise preferably included to measure the potential difference between the electrodes.

Without intending to be bound by any theory of operation, it is believed that the copper powder 10 of relatively low apparent density functions as a cathode to generate additional relatively low density powder upon which the deposition or plating is continued to increase the apparent density of the newly formed powder.

To effect electrodeposition, Circuit I is used. Current flows from the positive terminal of battery 24, through variable resistor 28 adjusted to introduce the desired current into the electrolytic cell 14, and to open cylinder copper anode 16 suspended in cell 14. The current then passes through electrolytic solution 12 causing plating of copper from solution onto the copper powder 10. The current then passes to electrode 22, and finally through conductor 18 back to the negative pole of battery 24.

In practice, the current, voltage and duration of plating are suitably selected to achieve the desired apparent density. The current density is the current in amperes per square inch of the geometric area of the boundary of the zone in which the copper powder is located. A current of from about 1 to about 2 amperes per square inch, and preferably about 1.4 amperes per square inch, of direct current is suitable with a voltage of from about 2.0 to 4.0 volts, and especially about 3.9 volts. The plating is continued until the desired apparent density is achieved.

In general, it has been found that as the concentration of a platable ion is increased, the voltage required to discharge it decreases. In a plating solution with hydrogen ions and copper ions, if the current density or voltage is great enough to discharge hydrogen ions and generate hydrogen gas, the gas restricts the volume and surface area in and on which the copper ions can discharge. Accordingly, when hydrogen gas is being generated, the differential plating density (ratio of the change in weight of powder to change in volume of powder) of the copper is low. In order to produce relatively high apparent density copper powder using lower apparent density copper powder as a cathode, it has been found that the current density should be of such a low magnitude that no hydrogen gas is formed. Hence, while specific values may be designated for specific systems, the important criterion which has been found to be related to the production of high apparent density copper powders using lower apparent density copper powder as a cathode is a combination of process parameters which will result in the electrodeposition of copper onto the low apparent density copper powder while avoiding the formation of hydrogen gas.

It has been found that interruption of the electrodeposition contributes to the production of high apparent density powder. The interruption is preferably effected by imposing reverse direct current on the system, as by using Circuit II shown in FIG. 1. It may also be achieved by imposing alternating current.

During the period of interruption, some deplating occurs caused by the reverse direct current or alternating current. This deplating has been found to improve the surface of the deposited particles, cause compaction, and to improve the apparent density.

On reversal from forward plating, a new solution condition comes into operation. This is a correction of the plating discharge depletion of the copper ions concentration in the layer of solution adjacent to the powder cathode. The layer is somewhat depleted during the forward plating. During the period of reverse current, there is a return of copper ions into the solution. The increase in local concentration should be proportional to the current. Thus, a high spot will generate a higher local concentration. On resumption of plating in the forward direction this higher concentration will enable more plating to take place over the area adjacent to the high spot thus leveling up the area. As the apparent density increases and the particles become more rounded and more regular, the reverse direct current or alternating current interruption can be tapered down.

The ratio of either deplating coulombs D.C. to plating coulombs D.C. or A.C. ampere-seconds to D.C. ampere-seconds is a control upon the rate of densification of the powder. A reverse to forward ratio of from about 5:95 up to about 45:55 defines a suitable operating range. Thus, the ratio of the duration of electrodeposition to the duration of interruption may be in the range from about 55:45 to about 95:5.

The reverse direct current may be from about 1.0 to about 2.0 amperes per square inch, and preferably about 1.8 amperes per square inch, at a voltage of from about 2.0 volts to about 4.0 volts. Interposed alternating current may be from about 0.5 to about 2.0 amperes per square inch, and preferably about 1.0 amperes per square inch.

The temperature at which the process of this invention is conducted may be from about 25° C to about 50° C, and preferably about 35° C.

The electrolytic solution is preferably agitated in the area of the low apparent density copper powder during electrodeposition. Thus, as embodied in FIG. 1, the powder 10 would be continuously agitated by rotating blade 40 of stirrer 38. This agitation has been found to lead to better results, including higher efficiency and more high apparent density product. It is believed that the agitation of the powder gives each particle an opportunity to receive copper deposited from the electrolytic solution, and is further believed to peen down small irregularities or micro roughness and break bridges that may have formed between the powder particles while they are still weak.

Any agitation means may be used in accordance with the invention. For example, agitation can be accomplished by tumbling the powder, turning the powder over by a jet of solution or a pulse of gas, etc. Horizontal stirring by a paddle or blade in a conical cathode zone, as shown in FIG. 1, is preferred because of its simplicity. When using the stirrer arrangement shown in FIG. 1, it has been found that a gentle stirring of from about 2 to about 10 revolutions per minute, and especially about 5 revolutions per minute, produces the desired results.

In addition to the gentle stirring, more vigorous agitation may be imposed to break up crusts which may form. On laboratory scale equipment, these may be visually observed and broken up by hand tool prodding.

The present invention therefore affords a relatively simple, highly efficient, method of producing high apparent density copper powder. In another aspect of the invention, there is provided a method of making the starting lower apparent density copper powder used as a cathode as described above, thus giving an integral process for the production of high apparent density copper powder starting with an electrolytic composition.

Figure 2:
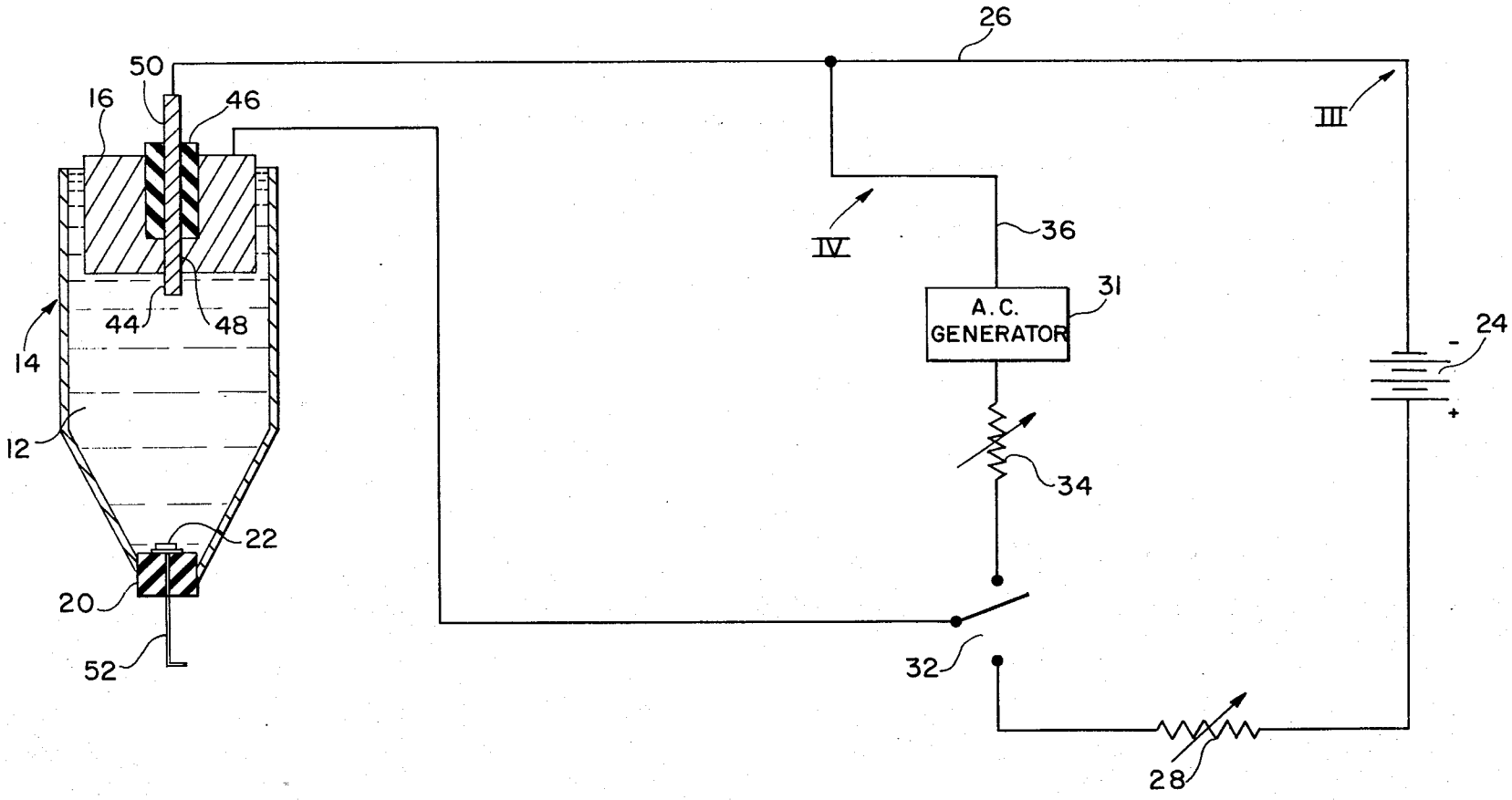
FIG. 2 shows schematically and in partial cross-section an assembly by which the process of electrodepositing copper from an electrolytic composition onto a cathode to produce relatively low apparent density copper powder may be carried out according to this invention.

FIG. 2 illustrates the apparatus in which the lower apparent density copper powder, useful as a cathode for generating higher apparent density powder, can be produced. One of the advantages of producing relatively low apparent density copper powder according to the method described herein is that essentially the same apparatus can be used as is subsequently used to produce high apparent density powder using the low apparent density powder as a cathode. It has particularly been found that the same electrolytic composition 12 can be used.

Thus, as shown in FIG. 2, the electrolytic composition 12 and electrolytic cell 14 may be the same as has been previously described in connection with FIG. 1. Cell 14 is provided with electrodes, and as embodied in and shown in FIG. 2, the electrodes comprise conductors 16 and 44. In the embodiment illustrated in FIG. 2, conductor 16 is the same as shown in connection with FIG. 1, and functions primarily as the anode. However, it may function as a cathode by reversal of current flow.

As shown and embodied in FIG. 2, conductor 44 is a metal rod, preferably of copper, having a sleeve 46 of an insulating material, e.g., a rubber tubing, which limits the active area of conductor 44 to lower rod portion 48 immersed in electrolytic composition 12.

A suitable conductor 44 for laboratory scale equipment was a 6 inch long copper rod having a diameter of 0.2 inch with lower rod portion 48 having a length of 2⅝ inches. Upper rod portion 50 is out of contact with the electrolytic composition 12.

Conductor 44 functions primarily as the cathode during electrodeposition, although by reversal of current flow, it can operate as an anode.

As shown and embodied in FIG. 2, the bottom portion of cell 14 is closed by insulated plug 20 through which extends wire 52 culminating in contact 22. Wire 52 culminating in contact point 22 does not participate in the electrodeposition process and the electrolytic cell 14 can be closed by any suitable means. However, the use of wire 52 culminating in contact 22, and plug 20, enables the system to be readily converted into use as described above in connection with FIG. 1, wherein wire 52 becomes conductor 18 when in communication with a source of electric current.

Conductors 16 and 44 are in communication with a source of electric current. In the embodiment illustrated in FIG. 1, the primary source of current for electrodeposition is shown schematically as direct current battery 24, which comprises the source of power for Circuit III. When in operation, Circuit III effects electrodeposition of copper from solution 12, cylinder 16 functioning as the anode and lower portion 48 of rod 44 functioning as the cathode.

As in the system shown in FIG. 1, it is preferred to employ a current regulating means, such as variable resistor 28, which permits variation and control of the current introduced into the electrolytic cell 14.

In the system for generating low apparent density powder, there is provided means for interrupting the electrodeposition process. As shown and embodied in FIG. 2, interruption is accomplished by employing a source of alternating current which introduces a period of current flow reverse to that created by battery 24, said source shown as A.C. generator 31, and comprising the source of power for Circuit IV.

As with Circuits I and II shown in FIG. 1, Circuits III and IV are alternative, and means for selecting the desired circuit is provided. As shown and embodied in FIG. 2, such means comprises switch mechanism 32. Preferably, a variable resistance means, shown in FIG. 2 as variable resistor 34, is used in conjunction with A.C. generator 31. Conductors 26 and 36, which may be ordinary electrical wire, connect sources of power 24 and 31 respectively to conductors 16 and 44 respectively.

A.C. generator 31 may, for example, be a 60 cycle, 115 volt A.C. generator, and preferably, means are provided to vary the A.C. output, such as by providing an autotransformer, e.g., as marketed under the name Variac. Instead of a source of alternating current, such as A.C. generator 31, a source of reverse direct current, such as a battery which may be the same as or different from battery 24, may be used to effect interruption of the electrodeposition process. Alternatively, Circuit IV may be eliminated, and interruption of the electrodeposition process accomplished by disconnecting Circuit III through switch mechanism 32 to provide periods in which no current flows into the electrolytic cell 14.

Any suitable switch mechanism 32, such as described above in connection with FIG. 1, may be used, and as with the FIG. 1 system, it is preferred to provide means for timed switching from one circuit to the other or for switching Circuit III on and off. Modifications, such as the placement of ammeters and voltmeter to measure current and potential differences respectively, will be apparent to those skilled in the art.

In practice, copper is plated on cathode 44 from electrolytic solution 12 during the electrodeposition process effected through operation of Circuit III. Current flows from the positive terminal of battery 24, through variable resistor 28 adjusted to introduce the desired current into the electrolytic cell 14, and to open cylinder copper anode 16 suspended in cell 14. The current then passes through electrolytic solution 12 causing plating of copper from the solution onto the copper cathode 44. The current then returns through conductor 26 back to the negative pole of battery 24.

The current, voltage and duration of plating are suitably selected to achieve a relatively low apparent density copper powder which is easily removed from the cathode, for example, by a simple hammer blow upon the end of the cathode or by a vibration from a 60 cycle electrical vibrator. Preferably, the low apparent density copper powder is of the dendritic form.

It has been found that the desired results are best obtained by a two-stage electrodeposition process. During the initial stage the current density should be of such a high magnitude that hydrogen gas is formed. During the second stage of powder generation the current density is generally lower and of such magnitude that no hydrogen gas is formed.

The initial stage is conducted at a current, based on the initial solid cathode area before deposition of powder thereon, of from about 2.5 to about 7.0 amperes per square inch, and preferably about 3.5 amperes per square inch, at a voltage of about 1.2 volts to about 1.6 volts, and preferably about 1.5 volts. The duration of the initial stage may vary, for example, from about 1 to about 10 minutes, and usually, about 5 minutes.

After the initial stage of electrodeposition, the second stage is conducted at a lower current of about 0.6 to about 2.4 amperes per square inch, and preferably about 2.1 amperes per square inch, at a voltage of from about 0.1 to about 1.0 volts, preferably about 0.5 volts. The duration of the second stage lower current density operation is usually longer than the duration of the initial stage, and may extend, for example, from about 10 to about 30 minutes, and is usually about 20 minutes.

During the second stage, the cathode may be cleared from about every 15 minutes to about every 60 minutes, and usually about every 40 minutes.

Both the initial and second stages of low apparent density powder generation are preferably conducted with periodic interruption. Where alternating current is used, it has been found that a current, based on initial solid cathode area before deposition of powder thereon, of from about 0.5 to about 2.0 amperes per square inch, and preferably about 1.0 amperes per square inch, is suitable, and the same values have been found to be suitable for second stage interruption as well.

The interruption may alternatively be effected by reverse direct current of about the same magnitude as the alternating current, or by periods of cessation of forward current flow. In general, the ratio of the period of interruption to the period of plating may be from about 5:95 to about 45:55.

The condition employed in the second stage of powder generation are generally the same as the electrodeposition conditions used in plating onto low apparent density powder to form high apparent density powder as described above. Hence, in the second stage of powder generation, some increase in apparent density is ordinarily achieved. In general, the apparent density of loose powder obtained by the powder generation method described herein may vary from about 0.5 to about 4.0 g/cc, and is preferably less than about 3.0 g/cc. The apparent density of higher apparent density copper powder using the method of this invention may vary, depending upon the apparent density of the powder used as a cathode, from about 2.5 to about 5.0 g/cc, and preferably starting with a powder having an apparent density less than about 3.0 g/cc is preferably at least above 3.0 g/cc.

Thus, in an important aspect of the present invention, there is provided an integral process for forming high apparent density copper powder starting with an electrolytic composition. By the copper powder generation method described herein, relatively low apparent density copper powder, the starting material for the production of higher apparent density copper powder, is readily formed using equipment which is then easily converted into the necessary apparatus for the production of higher apparent density copper powder.

The following non-limiting examples illustrate the practice of the invention to produce high apparent density copper powder.

Powder density measurements were made in 15 ml calibrated centrifuge tubes. The dry powder was added through a wide stem (powder) funnel. The tube was then tapped and dropped vertically 2 to 3 inches onto a rubber stopper until the powder no longer decreased in volume. The bouncing was usually for less than one minute. The tube and powder were then weighed on an analytical balance to the closest centigram and the tube tare substracted.

When first dried after plating, and before sieve sizing, the powder would occupy a few percent greater volume than after the sieving and measuring, consolidating or compositing and remeasuring. The working of the powder in sieving produced a better fitting together of the powder particles, hence a greater apparent density. This work included a small amount, usually 30 to 60 seconds, of grinding of the coarse fractions in a glass mortar with a glass pestle. This work is viewed as a correction of the crusting or plating together of particles because of small areas and volumes of stagnation of the powder by the simple rotary stirring used. This working of the coarser fractions would produce a relatively large amount of much finer powder. The powders hardly ever peened into flakes; the finer powder was produced by mild pressures and short treatment. In larger scale operations the self-attrition of the powder during stressing or tumbling in the plating cell can be expected to overcome this degree of crust formation or light cementing of particles. Nevertheless, the +60 fractions were small and are usually excluded from commercial powders.

Sieves used for 30, 60 and 200 mesh were of commercial meshes and were calibrated by comparison with a linear scale under a microscope. The 325 mesh sieve was a "U.S. Standard Sieve" manufactured by Newark Wire Cloth Company, Newark, N.J.

---

EXAMPLE 1

Apparatus Cylinder with 82° cone bottom, 4

-continued

EXAMPLE 1

| | |
|---|---|
| | inches deep, glass. |
| | Diameter, 2⅞ inches. |
| | Depth, 10" overall. |
| Solution | $CuSO_4 \cdot 5H_2O$ $H_2SO_4$ 53.7 g/liter 1.83 N H+ copper |
| Temperature: | 26 to 30° C |
| Anode: | 2½" × 6", split cylinder, 4" high |
| | Phase I |
| Cathode: | 2⅝" × 0.20" copper rod |
| Current: | D.C. 5.5A to 3.8A at 1.5 volts<br>A.C. 2.0A at 0.3 volts |
| Cycle: | 4 each, 4 to 6 second periods of A.C. per minute. |
| Stirring: | None |
| Anode Weight Change: | 3.8g after four fifteen minute intervals of plating. |
| Product Volume: | 35 mm high in the cone, initial height, decreasing, as further treated. |

Product cleared from cathode at end of each 15 minute interval by electrical vibrator applied to end of cathode.

| | | |
|---|---|---|
| | Phase II | |
| Cathode: | Contact through bottom of cell, 6" between cathode powder and anode. | |
| Current: | 1.8 to 1.4 ampere D.C. | 3.9 volts D.C. |
| | 1 ampere A.C. | 2.0 volts A.C. |
| Cycle: | 52 seconds D.C., 8 seconds A.C. (per minute) | |
| Stirring: | Paddle in powder 5 rpm plus hand prod to break crusts when present. | |

Product Measurements:

Product Measurements:

| Volume Ml | Wet/ Dry | Anode Wt Change | Powder Weight | Calculated/ Measured | Apparent Density |
|---|---|---|---|---|---|
| | | | Phase I | | |
| (5.8 min) | Wet | 3.8 | 3.8g | Calculated | (0.65) |
| | | | Phase II | | |
| 5.8 | Wet | 3.1 | 6.9 | Calculated | 1.19 |
| 5.8 | " | 1.8 | 8.7 | " | 1.58 |
| 5.5 | " | 1.7 | 10.4 | " | 1.89 |
| 5.8 | " | 2.5 | 12.9 | " | 2.22 |
| 5.8 | " | 4.1 | 17.0 | " | 2.94 |
| 6.1 | Wet | 4.1 | 21.2 | Calculated | 3.45 |
| 5.7 | Dry, sieved | | 21.5 | Measured | 3.78 |
| 6.8 | " | | 26.8 | " | 4.08 |
| 8.2 | " | | 34.7 | " | 4.23 |

The sieve analysis of this powder before compositing for final measurement was:

| Mesh | Vol, ml | Weight, gms | App. Density |
|---|---|---|---|
| +30 | 0.05 | (Rejected) | |
| −30 +60 | 2.20 | 7.30 | 3.32 |
| −60 +200 | 6.20 | 24.60 | 3.96 |
| −200 +325 | 0.70 | 2.59 | 3.70 |
| −325 | 0.08 | 0.21 | 2.6 |
| Composited | 8.20 | 34.74 | 4.23 |

EXAMPLE 2

A sample of -200 mesh powder produced according to Example 1 and measuring:

EXAMPLE 2

A sample of −200 mesh powder produced according to Example 1

-continued

EXAMPLE 2

| | | | |
|---|---|---|---|
| and measuring: | | | |
| +325 mesh | 20% weight | Apparent Density | 1.6 |
| −325 mesh | 80% weight | " | 1.3 |
| Composited | | | 1.42 |

was selected as a base upon which to show that interposed A.C. and periodic reversed D.C. were both effective in plating upon a low density powder to produce a higher apparent density product.

| | | |
|---|---|---|
| Apparatus: | Initially, the 82° cone of Example 1. In later state, a 60° cone was exchanged after 3.80 apparent density. | |
| Solution: | $CuSO_4 \cdot 5H_2O$ | 53.7 g/liter $CU^{++}$ |
| | $H_2SO_4$ | 1.83 N $H^+$ |
| Temperature: | 33° to 38° C | |
| Anode: | 187 g ⅛" sheet, initial | |
| Cathode: | Powder, 1.42 apparent density | |
| Current: | D.C. 1.2 ampere<br>A.C. 0.8 ampere | |
| Cycle: | 53 seconds D.C., 7 seconds A.C. (per minute) | |
| Stirring: | per Example 1, Phase 2. | |

The plating was interrupted periodically, the powder washed, rinsed with alcohol, vacuum dried, sieved and measured. The composited sample weights, volumes, apparent densities are given:

| Weight grams | Volume ml | App. Density | Differential Plating Density |
|---|---|---|---|
| 5.0 | 3.5 | 1.42 | |
| 6.3 | 3.40 | 1.84 | |
| 8.4 | 3.8 | 2.22 | |
| 10.4 | 3.8 | 2.73 | |
| 12.7 | 3.9 | 3.24 | |
| 19.4 | 5.1 | 3.80* | |
| 20.6 | 5.0 | 4.13 | 8.5 |
| 23.2 | 5.4 | 4.37 | 5.4 |
| 36.2 | 7.7 | 4.76 | 5.8 |

*60° cone used for following plating.

The final sieve analysis was:

The final sieve analysis was:

| Mesh | Vol. ml | Weight | App. Density |
|---|---|---|---|
| +60 | 0.15 | 0.38 | 2.5 |
| −60 +200 | 6.70 | 29.96 | 4.48 |
| −200 +325 | 1.30 | 5.52 | 4.26 |
| −325 | 0.08 | 0.30 | 3.76 |
| Composited | | | 4.76 |

EXAMPLE 3

EXAMPLE 3

| | |
|---|---|
| Apparatus: | 60° cone with bottom contact |
| Solution: | Same as Example 2 |
| Temperature: | 30 – 35° C |
| Anode: | ⅛" sheet, approximately 150 g initial weight |
| Cathode: | Powder, 1.42 apparent density |
| Current: | Periodic Reverse D.C.<br>2.0 amperes forward, nominal<br>1.8 amperes reversed, nominal |
| Cycle: | 1 minute: 49 seconds forward<br>11 seconds reverse |
| Stirring: | Paddle in powder, 5 rpm, with manual |

-continued

| EXAMPLE 3 | |
|---|---|
| | breakup of any crusts observed |

The plating was interrupted periodically to rinse, dry, and measure the product produced. The composited sample weights, volumes, and apparent densities are given:

| Weight grams | Vol, ml | App. Density | Differential Plating Density |
|---|---|---|---|
| 4.1 | 2.9 | 1.42 | — |
| 6.2 | 2.8 | 2.24 | — |
| 9.1 | 3.3 | 2.75 | 5.6 |
| 11.3 | 3.6 | 2.75 | 7.8 |
| 13.6 | 3.8 | 3.59 | 6.9 |
| 16.7 | 4.2 | 3.98 | 7.7 |
| 19.3 | 4.6 | 4.17 | 6.4 |

The foregoing examples illustrate the production of high apparent density copper powder according to this invention. Many advantages flow from the production of such powder. For example, one field of use is in the pressure molding of shapes employing copper powder. Among the advantages of using a higher density metal powder in this capacity are: the smaller volume of powder needed to fill the mold leading to more economical and efficient operation resulting from, for example, the shorter distance of travel of a compaction ram; increased flow rate from a feed hopper; less total surface area and therefore lessened possibility of surface oxidation; less free space in the mold and therefore less air to be displaced so that fewer final voids occur and compaction is faster; less container, storage, and shipping space required, etc.

Additional advantages and modifications will readily occur to those skilled in the art. The invention in its broader aspects is therefore not limited to the specific details shown and described, but departures may be made from such details without departing from the spirit or scope of the invention.

What is claimed is:

1. A method of producing copper powder of relatively high apparent density comprising the steps of:

a. providing a copper powder cathode in which the copper powder has an apparent density from about 0.5 to about 4.0 g/cc; and a metal anode in an electrolytic composition comprising an aqueous solution of copper sulfate and sulfuric acid;

b. imposing direct electrical current on the electrolytic composition so as to effect electrodeposition of copper from the from the electrolytic composition onto the copper powder cathode, the electrical current being of a current density such that no hydrogen gas is evolved;

c. periodically interrupting the flow of direct electrical current, the ratio of the period of direct current flow to the period of interruption being from about 95:5 to about 55:45;

d. agitating the copper powder cathode during electrodeposition; and e. continuing the electrodeposition of copper onto the copper powder cathode until copper powder having a desired apparent density in the range of from about 2.5 to about 5.0 g/cc and which is greater than the apparent density of the starting copper powder of the copper powder cathode is formed.

2. A method according to claim 1 in which the direct current flow is interrupted by imposing reverse direct electrical current on the electrolytic composition.

3. A method according to claim 1 in which the direct current flow is interrupted by imposing alternating electrical current on the electrolytic composition.

4. A method according to claim 1 in which the copper powder of the copper powder cathode has an apparent density of less than about 3.0 g/cc, and the electrodeposition is continued until copper powder is formed having an apparent density of at least about 3.0 g/cc.

5. A method according to claim 1 in which direct electrical current of from about 1.0 to about 2.0 amperes per square inch of the approximate boundary area of the copper powder cathode zone, with a voltage of from about 2.0 to about 4.0 volts, is imposed on the electrolytic composition to effect electrodeposition of copper onto the copper powder cathode.

6. A method according to claim 2 in which reverse direct electrical current of from about 1.0 to about 2.0 amperes per square inch of the approximate boundary area of the copper powder cathode zone, with a voltage of from about 2.0 to about 4.0 volts, is periodically imposed on the electrolytic composition to effect interruption of the electrodeposition of copper onto the copper powder cathode.

7. A method according to claim 1 in which the metal anode is a copper anode.

8. A method of producing copper powder of relatively high apparent density comprising the steps of:

a. providing a metal anode and a metal cathode in a first electrolytic composition containing copper ions;

b. electrodepositing copper from the electrolytic composition onto the metal cathode to form copper powder having a relatively low apparent density of less than about 3.0 g/cc;

c. freeing the copper powder from the metal cathode;

d. placing the copper powder in a second electrolytic composition containing copper ions and in which there is provided a metal anode;

e. electrodepositing copper from the second electrolytic composition onto the copper powder having a relatively low apparent density of less than about 3.0 g/cc; and f. continuing the electrodeposition of step (e) until copper powder having an apparent density of at least 3.0 g/cc is formed.

9. A method according to claim 8 in which the first electrolytic composition and the second electrolytic composition have the same composition.

10. A method according to claim 8 in which the metal cathode of step (a) is a copper cathode.

11. A method according to claim 8 in which the electrodeposition of step (b) is effected in two stages, the first stage being effected by imposing electrical current on the first electrolytic composition of a current density such that hydrogen gas is evolved, and the second stage being effected by imposing electrical current on the first electrolytic composition of a current density such that no hydrogen gas is evolved.

12. A method according to claim 11 in which the electrodeposition of step (e) is effected by imposing electrical current on the second electrolytic composition of a current density such that no hydrogen gas is evolved.

13. A method according to claim 11 in which the electrical current imposed to effect the electrodeposition of step (b) is direct current in both of the two stages of electrodeposition, and the direct current is interrupted in each stage by periods during which alternating current is imposed on the first electrolytic composition.

14. A method according to claim 12 in which the electrical current imposed to effect the electrodeposition of step (e) is direct current and the direct current is interrupted by periods during which reverse direct current is imposed on the second electrolytic composition.

15. A method according to claim 12 in which the electrical current imposed to effect the electrodeposition of step (e) is direct current, and direct current is interrupted by periods during which alternating current is imposed on the second electrolytic omposition.

16. A method of producing copper powder of relatively high apparent density comprising the steps of:

a. providing a solid metal anode and a solid metal cathode in an electrolytic composition comprising an aqueous solution of copper sulfate and sulfuric acid;

b. imposing direct electrical current on the electrolytic composition of a current density such that hydrogen gas is evolved so as to effect electrodeposition of copper from the electrolytic composition onto the solid metal cathode to form copper powder on the cathode;

c. periodically interrupting the flow of direct electrical current by imposing alternating current on the electrolytic composition, the ratio of the period of direct current flow to the period of alternating current flow being from about 95:5 to about 55:45;

d. continuing the electrodeposition of copper from the electrolytic composition onto the solid metal cathode to form copper powder having an apparent density of from about 0.5 to about 4.0 g/cc on the cathode by reducing the current density of the imposed direct electrical current to a current density such that no hydrogen gas is evolved;

e. periodically interrupting the flow of direct electrical current of reduced current density by imposing alternating current on the electrolytic composition, the ratio of the period of direct current flow to the period of alternating current flow being from about 95:5 to about 55:45;

f. freeing the copper powder formed during steps (b) and (d) from the solid metal cathode and placing the copper powder as a cathode in an electrolytic composition of the same composition as that provided in step (a);

g. providing a metal anode in the electrolytic composition with the copper powder cathode;

h. imposing direct electrical current on the electrolytic composition so as to effect electrodeposition of copper from the electrolytic composition onto the copper powder cathode, the electrical current being of a current density such that no hydrogen gas is evolved;

i. periodically interrupting the flow of direct electrical current by imposing reverse direct electrical current on the electrolytic composition, the ratio of the period of direct current flow to the period of reverse direct current flow being from about 95:5 to about 55:45;

j. agitating the copper powder cathode during electrodeposition; and k. continuing the electrodeposition of copper onto the copper powder cathode until copper powder having a desired apparent density in the range of from about 2.5 to about 5.0 g/cc and which is greater than the apparent density of the copper powder of the copper powder cathode is formed.

17. A method according to claim 16 in which the electrodeposition of step (d) is continued until copper powder having an apparent density of from about 0.5 to less than about 3.0 g/cc is formed, and the electrodeposition of step (k) is continued until copper powder is formed having an apparent density greater than the apparent density of the copper powder of the copper powder cathode in the range of from about 3.0 to about 5.0 g/cc.

* * * * *